US006798153B2

(12) United States Patent
Mattas et al.

(10) Patent No.: US 6,798,153 B2
(45) Date of Patent: Sep. 28, 2004

(54) METHOD OF REGULATING POWER IN A HIGH-INTENSITY-DISCHARGE LAMP

(75) Inventors: Charles B. Mattas, Glenview, IL (US); Oscar J. Deurloo, Arlington Heights, IL (US); Vincent J. Delia, Chicago, IL (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/921,031

(22) Filed: Aug. 2, 2001

(65) Prior Publication Data

US 2003/0025463 A1 Feb. 6, 2003

(51) Int. Cl.[7] ..... H05B 37/00
(52) U.S. Cl. ..... 315/307; 315/308; 315/224
(58) Field of Search ..... 315/307, 308, 315/224

(56) References Cited

U.S. PATENT DOCUMENTS 4,396,872 A 8/1983 Nutter ..... 315/308
4,590,408 A * 5/1986 Mays ..... 315/403
5,103,143 A * 4/1992 Daub ..... 315/308
5,198,728 A * 3/1993 Bernitz et al. ..... 315/307
5,623,187 A * 4/1997 Caldeira et al. ..... 315/307
5,691,607 A * 11/1997 Zawislak et al. ..... 315/308
5,939,838 A 8/1999 Janik ..... 315/277

FOREIGN PATENT DOCUMENTS

WO WO0040058 6/2000 ..... H05B/41/00

OTHER PUBLICATIONS

Anti–flickering circuit for high pressure discharge lamp, Jul. 10, 1991.*

* cited by examiner

*Primary Examiner*—David Vu

(57) ABSTRACT

A system and method of controlling power to a high-intensity-discharge lamp is provided. A voltage sensor determines voltage across the lamp. A current sensor determines current through the lamp. A control circuit approximates lamp power based on input from the sensors, compares the lamp power against a desired level, and regulates lamp power based on the comparison.

20 Claims, 4 Drawing Sheets

METHOD OF REGULATING POWER IN A HIGH-INTENSITY-DISCHARGE LAMP

TECHNICAL FIELD

The invention relates to ballast circuits for operating high-intensity-discharge lamps and in particular to a novel ballast circuit to regulate lamp power over a wide range of supply and lamp voltages.

BACKGROUND OF THE INVENTION

High-intensity-discharge lamps consist of tubes in which electric arcs in a variety of materials are produced. An outer glass envelope provides thermal insulation in order to maintain the arc tube temperature. The temperature of the arc tube influences the color of the light produced and the life expectancy of the lamp. A ballast circuit is used to provide a high voltage to initiate an arc in the arc tube and supply power to maintain the arc. By regulating the power supplied to the lamp, the arc tube temperature can be controlled. Examples of high-intensity-discharge lamps include metal halide and high-pressure sodium-vapor lamps. Recent advances in high-intensity-discharge lamps have improved the color, start up time, and life expectancy opening doors to new markets previously dominated by incandescent lamps. One draw back of the new high-intensity-discharge lamps is that the new lamps require tighter power supply regulation.

A typical high-intensity-discharge ballast circuit is shown in FIG. 1. The circuit consists of an inductor 250 in series with the lamp 256 and a capacitor 254 shunting the voltage supply 252 for power factor correcting. The inductor is typically sized to provide optimal power to a nominal lamp at a given supply voltage. The power supplied to the lamp ($P_{lamp}$) will be the voltage across the lamp ($V_{lamp}$) multiplied by the current through the lamp ($I_{lamp}$). Appling Ohms law, $I_{lamp}$ equals $V_{lamp}$ divided by the lamp resistance ($R_{lamp}$). Summing the voltages around the circuit, supply voltage ($V_{supply}$) will equal the voltage across the inductor ($V_{inductor}$) plus $V_{lamp}$. Rewriting the power equation yields $P_{lamp}=(V_{supply}-V_{inductor})^2/R_{lamp}$. As the lamp ages, it's resistance may decrease. Many utility companies consider variations in supply voltage up to ten percent from nominal typical and acceptable. Changing loads on the power supply may cause the voltage to vary more than the typical ten percent in some applications. As shown in the above lamp power equation, variations in lamp resistance and supply voltage can cause the power supplied to the lamp to vary. In many lighting applications, it is desirable to have a lamp emitting a constant light intensity, which requires providing constant power to the lamp. In addition to providing consistent light intensity, a constant power supply may increase the life of the lamp. In other applications it may be desired to operate the lamp at various constant power levels to dim, reduce power consumption, or change the color of the lamp.

Electronic ballasts are available today, which provide constant power and dimming capabilities. However, these ballasts are much more expensive. The increased expense may be due to the additional circuitry required to sense, calculate, and regulate the power supplied to the lamp. Of the three circuits, the one used to calculate the power in the lamp is usually most expensive. As noted above, the power supplied to a lamp may be calculated by multiplying the voltage across the lamp times the current passing through the lamp. Circuits to multiply generally are complicated and require a high level of precision accounting for the high cost.

What is therefore needed is a ballast circuit that will provide constant power utilizing an inexpensive power regulating circuit, and provide for optional dimming of the lamp.

SUMMARY OF THE INVENTION

One aspect of the invention provides a method of controlling power to a high-intensity-discharge lamp. Voltage across and current through the lamp are determined. Power to the lamp may be approximated using the voltage and current. Power to the lamp can be regulated based on a comparison of the approximated power and a predetermined value.

Current through the lamp is determined by converting the current to a representative voltage. The voltage across the lamp is determined by scaling the lamp voltage. Lamp power is approximated by the summation of the representative voltage and the scaled voltage. A comparison is made whether the approximated power is greater or less than the predetermined value.

Another aspect of the invention provides a system of controlling power to a high-intensity-discharge lamp. Voltage across the lamp is determined by a voltage sensor. Current through the lamp is determined by a current sensor. A control circuit is operatively connected to the current sensor and voltage sensor. The control circuit approximates a lamp power based on input from the sensors. The control circuit compares the lamp power against a desired level and regulates lamp power based on the comparison. The current sensor comprises a resistor connected in series with the lamp. A signal conditioning circuit scales and filters the output of the current sensor. The voltage sensor comprises a voltage divider network shunting the lamp. The voltage divider includes a voltage-limiting network. The control circuit includes a summing circuit. The summation circuit includes a filter and a plurality of rectifiers. The control circuit includes a voltage reference signal generator. The signal generator produces a saw tooth waveform synchronized with the sensed current and twice the frequency of the sensed current. The control circuit includes a current limiting component. The control circuit includes a comparator circuit.

The foregoing and other features and advantages of the invention will become further apparent from the following detailed description of the presently preferred embodiments, read in conjunction with the accompanying drawing.

DETAILED DESCRIPTION OF THE PRESENTLY PREFERRED EMBODIMENTS

Figure 1:
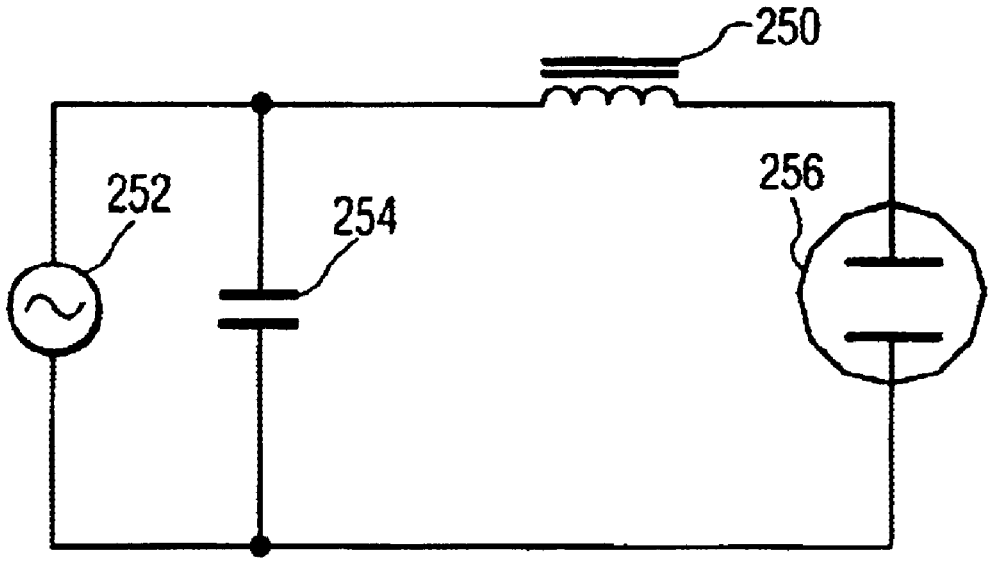
FIG. 1 Prior Art
FIG. 1 is prior art showing a schematic view of a typical magnetic ballast.
Figure 2:
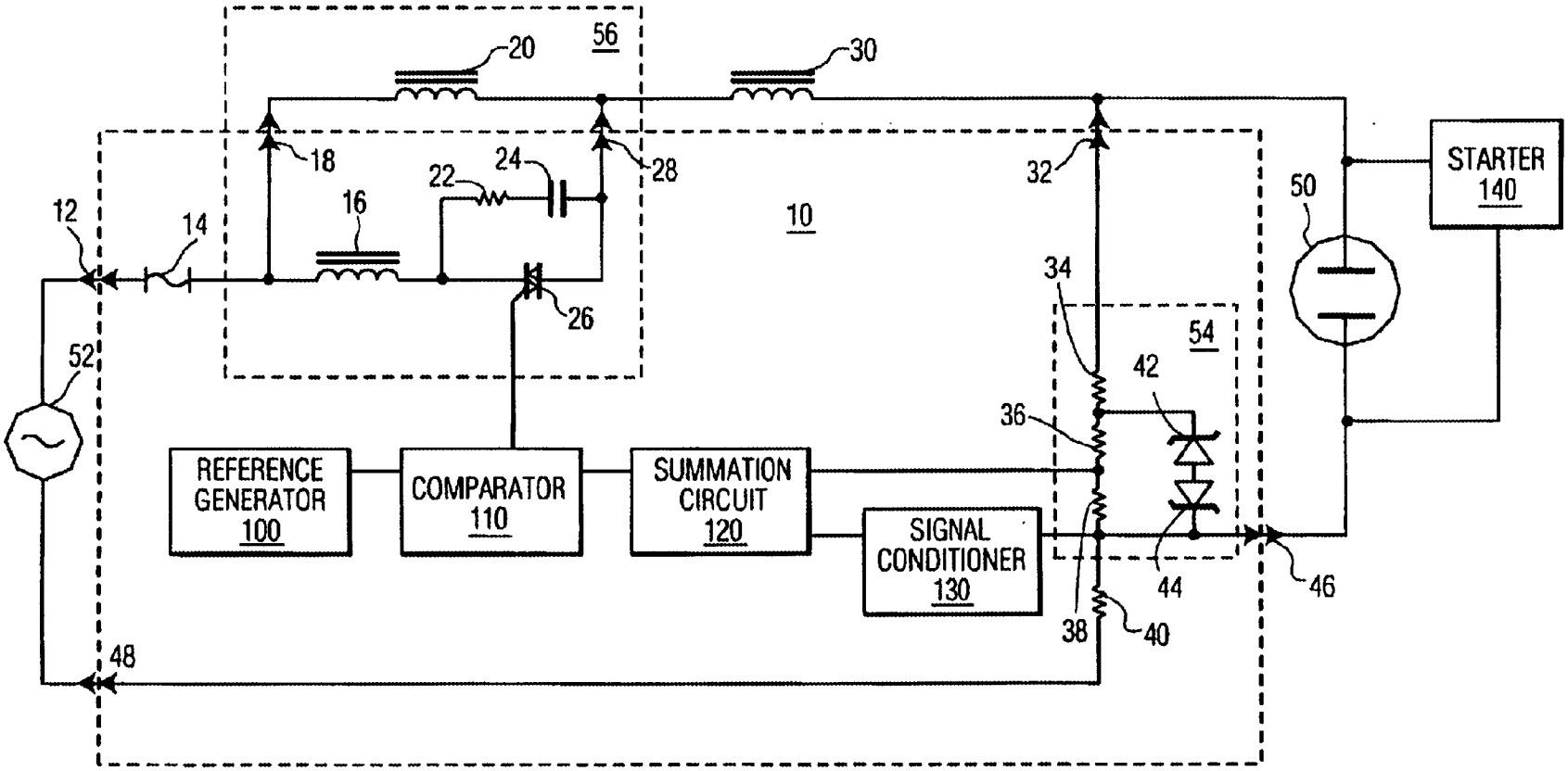
FIG. 2 is a partially schematic, partially block diagram of one embodiment of a high-intensity-discharge lamp ballast circuit with power regulation.

One embodiment of a ballast circuit to regulate lamp power is illustrated in FIG. 2 designated in the aggregate as numeral 10. The ballast circuit may include sensors to allow determining voltage across and current through the lamp and a control circuit that calculates lamp power using information from the sensors, compares the lamp power against a desired level, and regulates lamp power based on the comparison.

A sensor may sense the current through a lamp. In one embodiment, the current sensor may comprise a resistor 40 connected in series with the lamp 50. One side of the resistor 40 may be connected to a terminal 48 to which the neutral of an AC voltage supply 52 may be connected. The other side of the resistor may be connected to a signal conditioner circuit 130, resistor 38 and zener diode 44 of the voltage sensing network 54, and a terminal 46 to which one side of the lamp 50 may be connected. Those skilled in the art will recognize that the resistor 40 may be replaced with a network of resistors to obtain a desired resistance and power dissipation.

A sensor may sense the voltage across the lamp. In one embodiment, the voltage sensor 54 may comprise three resistors 34, 36, and 38 connected in series to form a voltage divider. Resistors 36 and 38 may be shunted by two zener diodes 42 and 44 connected in series anode to anode. The zener diodes 42 and 44 may be selected to limit the voltage across resistors 36 and 38. Limiting the voltage can reduce the starting voltage component of the voltage sensor output waveform. By reducing the starting voltage component, a more accurate representation of lamp voltage may be obtained. Resistor 34 may be connected to a terminal 32 to which the other side of the lamp 50 and an inductor 30 may be attached. Resistors 38 and 36 may connect to one input of the summation circuit 120.

The ballast circuit may include a control circuit that calculates lamp power using information from the sensors, compares the lamp power against a desired level, and regulates lamp power based on the comparison. In one embodiment, the control circuit may comprise a signal conditioner 130, summation circuit 120, comparator 110, reference generator 100, and current limiting circuit 56 controlled by the comparator.

A signal conditioner circuit may be connected to the output of the current sensor to condition the signal for processing. In one embodiment, the signal conditioner 130 may amplify the voltage across the current sensing resistor 40. Those skilled in the art will recognize the need for such amplification as the output voltage of the current sensor of the type described above is usually kept low for power considerations.

Figure 4:
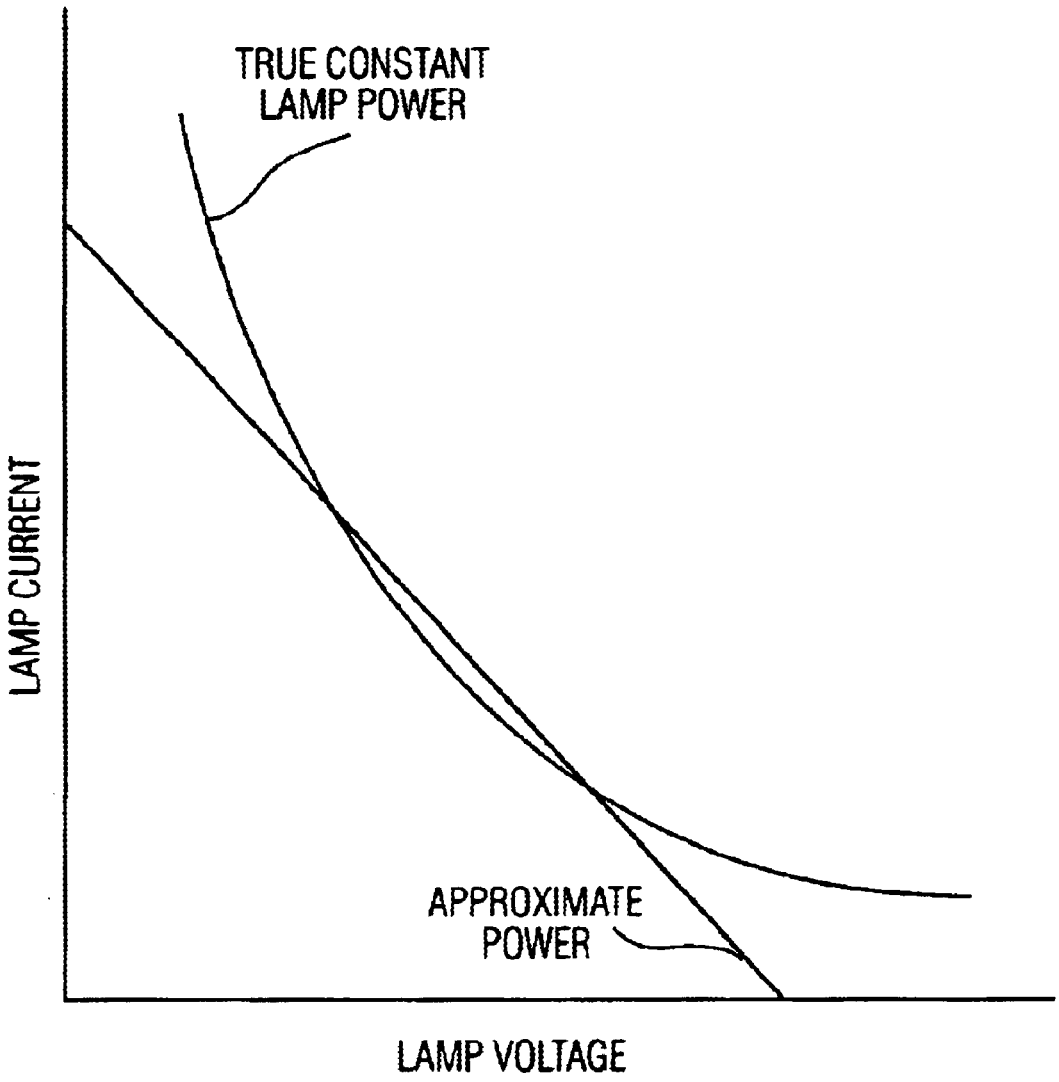
FIG. 4 shows a plot of true constant power and a linear function approximating true power.

A summation circuit may be used to calculate the approximate power by adding the voltages representing lamp voltage and current. The summation circuit 120 may add the absolute value of the voltages from the signal conditioner 130 and voltage sensor 54. The summation circuit 120 may include a filter to average the sum of the two voltages over time. True lamp power may be calculated by multiplying lamp current and lamp voltage. FIG. 4. shows a plot of true constant lamp power over a range of lamp voltages and currents. A linear function of current and voltage, also plotted in FIG. 4, may be found that approximates true constant lamp power over a range of lamp voltages and currents. The equation for the linear function may be expressed by the equation, $K=A(V_{lamp})+B(I_{lamp})$. Whereas, $I_{lamp}$ is the lamp current, $V_{lamp}$ is the lamp voltage, and K, A, and B are constants. The linear equation and FIG. 4 show that an approximate lamp power may be calculated by summing scaled lamp voltage and current.

A reference generator may be used to generate a reference voltage for comparing to the voltage representing approximant power. In one embodiment, the reference generator 100 may produce a saw tooth waveform synchronized to the supply voltage waveform. The saw tooth waveform may be of a frequency twice that of the supply voltage. The amplitude of the saw tooth waveform may increase with time to a desired level then reset.

A comparator circuit may compare the power level of the lamp to a desired level and output a signal based on the comparison. In one embodiment, the comparator 110 may compare the voltage level representing approximant actual power to the reference waveform. The comparator 110 may have an electrically isolated output. The comparator 110 may have a reset function limiting the active pulse width to a desired duration. Those skilled in the art will recognize comparing a low voltage from the summation circuit 120, indicating power to the lamp is low, to an increasing saw tooth waveform may result in an output signal becoming active sooner than the output signal when a higher voltage from the summation circuit 120 is compared. They will also recognize that this type of signal may be used to control the conduction angle of a triac, insulated gate bipolar transistor (IGBT), silicon controlled rectifier (SCR), or other electronic switch.

An electronic switch may shunt a load-limiting device to control the power to a lamp. In one embodiment, the current limiting portion 56 of the control circuit may include an inductor 20 connected in parallel to an inductor 16 in series with a triac 26 through terminals 18 and 28. The gate of the triac 26 may be connected to the output of the comparator circuit 110. The triac 26 may be shunted by a snubbing circuit comprised of resistor 22 and capacitor 24 connected in series. The inductors 16 and 20 may be connected to a fuse 14. The other side of the fuse 14 may be connected to a terminal 12 to which the line side of a voltage supply 52 may be connected. Those skilled in the art will recognize when the triac 26 is not conducting, inductors 20 and 30 may limit the power to the lamp 40. When the triac 26 is conducting, inductor 30 and the effective inductance of inductors 16 and 20 in parallel may limit the power in the lamp 40. If the conduction angle of the triac is varied, any average power level between the two said levels may be achieved. They will also recognize that inductor 20 may be replaced with a resistor, a resistor in series with a capacitor, or other current limiting device.

In operation, the ballast circuit may sense voltage across and current through the lamp, calculate lamp power using information from the sensors, compare the lamp power against a desired level, and regulate lamp power based on the comparison.

Figure 3:
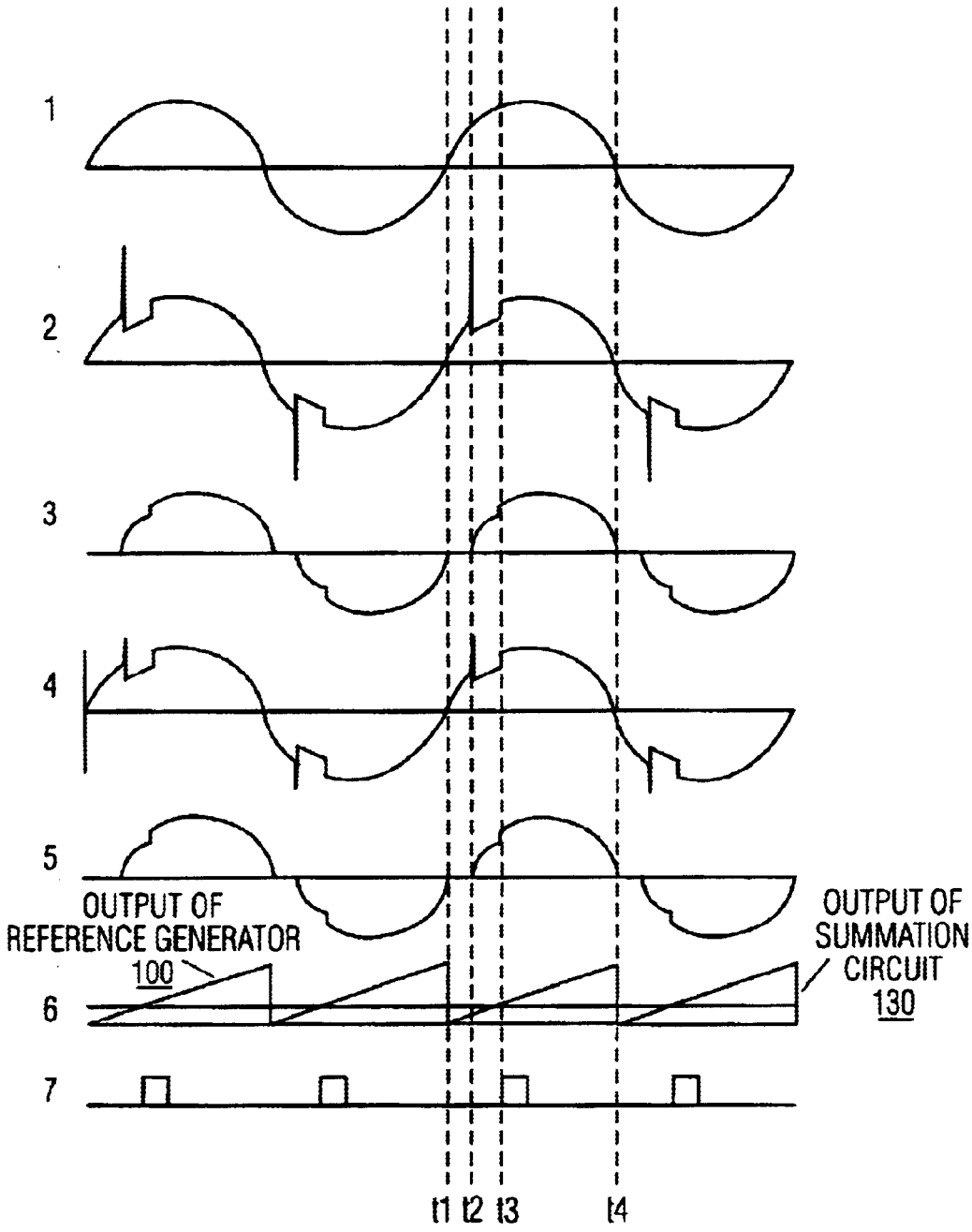
FIG. 3 shows a timing diagram of waveforms in the ballast circuit of FIG. 2.

FIG. 3 shows a timing diagram for waveforms in one embodiment of the ballast circuit 10. Diagram 1 shows the voltage waveform of the power supply 52. Diagram 2 shows the voltage waveform of the lamp 50. Diagram 3 shows the current waveform of the lamp 50. Diagram 4 shows the voltage waveform at the output of the voltage sensor 54. Diagram 5 shows the voltage waveform of the signal conditioner 130 output. Diagram 6 shows the waveforms of the reference generator 100 and the output of the summation circuit 120. Diagram 7 shows the output signal of the comparator 110.

During the time from t1 to t2, the arc in the lamp may be extinguished. When there is no arc in the lamp, any current flow through the lamp 50 and resistor 40 may be negligible. If no current is passing through resistor 40, no voltage may be developed across the resistor 40 or the input of the signal conditioner. With no voltage applied to the input of the signal conditioner 130, the output of the signal conditioner 130 may be zero. If no current is flowing through the lamp 50, the lamp voltage can equal the supply voltage. The voltage across the lamp 50 may be divided by resistors 34, 36, and 38 resulting in a scaled lamp voltage being applied to the summation circuit 120. If the sum of the absolute value of the inputs to the summation circuit 120 is less than the output of the summation circuit 120, the output voltage of the summation circuit 120 may decrease slightly.

At the time t2, the voltage across the lamp 50 may increase to a level triggering the starter circuit 140 to apply a high voltage across the lamp 50. The high voltage from the starter circuit 140 may initiate an arc in the lamp 50. As the starter voltage is divided by the resistors 34, 36, and 38, the voltage across resistors 36 and 38 may increase. When the voltage across resistors 36 and 38 increases to the zener voltage of the zener diodes 42 and 44, the diodes may start conducting limiting the voltage to the input of the summation circuit 120.

During the time between t2 and t3, an arc may be present in the lamp 50 allowing current to flow through the lamp 50, resistor 40, and inductors 20 and 30. The current through resistor 40 may produce voltage across resistor 40. The signal conditioner 130 may amplify the voltage across resistor 40 and output a voltage to the summation circuit 120 representative of the lamp current. The voltage of lamp 50 may be equal to the supply voltage less the voltage drop across inductors 20 and 30. The lamp voltage may be scaled by the voltage divider resulting in a scaled voltage to the input of the summation circuit 120.

At the time t3, the voltage from the reference generator 100 may exceed the output voltage from the summation circuit 120. When the voltage from the reference generator 100 first exceeds the summation circuit 120 output voltage, the comparator 110 may output a pulse to the gate of the triac 26 causing the triac 26 to conduct. Once the triac 26 conducts, it will remain in the conducting state until the current passing through the triac 26 goes to zero even if the voltage to the gate is removed. When the triac 26 is conducting, the lamp voltage and current may increase due to the reduced inductance of inductor 16 in parallel with inductor 20.

At the time t4, the lamp voltage and current pass through zero resetting the reference generator 100. When there is no current through the triac, the triac will go into a non-conducting state. When there is no lamp voltage, the arc will extinguish. Those skilled in the art will recognize that the control circuit is bipolar and the above operation will repeat on the negative portion of the supply voltage.

While the embodiments of the invention disclosed herein are presently considered preferred, various changes and modifications can be made without departing from the spirit and scope of the invention. The scope of the invention is indicated in the appended claims, and all changes that come within the meaning and range of equivalents are intended to be embraced therein.

What is claimed is:

1. A system of controlling power to a high-intensity-discharge lamp, said system comprising:

a voltage sensor operable to generate a first sensing voltage indicative of a voltage across the lamp;

a current sensor operable to generate a second sensing voltage indicative of a current through the lamp; and a control circuit operable to approximate a lamp power as a function of the first sensing voltage and the second sensing voltage, to compare the approximated lamp power and a reference voltage, and to regulate the power to the lamp based on the comparison of the approximated lamp power and the reference voltage, wherein said control circuit includes a summing circuit operable to generate a summation voltage as a function of a summation of the first sensing voltage and the second sensing voltage, the summation voltage being indicative of the approximated lamp power;

wherein said voltage sensor is in electrical communication with said control circuit to apply the first sensing voltage to said control circuit, and wherein said current sensor is in electrical communication with said control circuit to apply the second sensing voltage to said control circuit.

2. The system of claim 1, wherein said voltage sensor includes a voltage divider connected to said lamp to thereby generate the first sensing voltage; and wherein said voltage divider is further connected to said control circuit to thereby apply the first sensing voltage to said control circuit.

3. The system of claim 1, wherein said current sensor includes a resistor connected to said lamp to thereby generate the second sensing voltage; and wherein said resistor is further connected to said control circuit to thereby apply the second sensing voltage to said control circuit.

4. The system of claim 3, wherein said voltage sensor includes a voltage divider connected to said lamp to thereby generate the first sensing voltage; and wherein said voltage divider is further connected to said control circuit to thereby apply the first sensing voltage to said control circuit.

5. A system controlling power to a high-intensity-discharge lamp, said system comprising:

a voltage sensor operable to generate a first sensing voltage indicative of a voltage across the lamp;

a current sensor operable to generate a second sensing voltage indicative of a current through the lamp; and a control circuit operable to approximate a lamp power as a function of the first sensing voltage and the second sensing voltage, to compare the approximated lamp power and a reference voltage, and to regulate the power to the lamp based on the comparison of the approximated lamp power and the reference voltage, wherein said voltage sensor is in electrical communication with said control circuit to apply the first sensing voltage to said control circuit, and wherein said current sensor is in electrical communication with said control circuit to apply the second sensing voltage to said control circuit, wherein said control circuit includes:

a summing circuit operable to generate a summation voltage as a function of a summation of the first sensing voltage and the second sensing voltage, the summation voltage being indicative of the approximated lamp power;

a reference generator operable to generate the reference voltage; and a comparator in electric communication with said summing circuit whereby the summation voltage is applied to said comparator and in electric communication with said reference generator whereby the reference voltage is applied to said comparator, said comparator operable to compare the summation voltage and the reference voltage to thereby generate a control voltage for regulating the power to the lamp.

6. The system of claim 5, wherein said summing circuit includes means for adding a first absolute value of the first sensing signal and a second absolute value of the second sensing signal to thereby generate the summation voltage.

7. The system of claim 5, wherein said summing circuit includes means for adding a first average of the first sensing signal and a second average of the second sensing signal to thereby generate the summation voltage.

8. The system of claim 5, wherein the reference voltage has a sawtooth waveform.

9. The system of claim 5, wherein said control circuit further includes:

a current limiting circuit in electric communication with said comparator whereby the control voltage is applied to said current limiting circuit, wherein said current limiting circuit is operable to transition among a plurality of inductive states as a function of the control voltage, and wherein the current limiting circuit is in electric communication with said lamp to regulate the power to the lamp as a function of the plurality of the inductive states.

10. A system of controlling power to a high-intensity-discharge lamp, said system comprising:

a voltage sensor operable to generate a first sensing voltage indicative of a voltage across the lamp;

a current sensor operable to generate a second sensing voltage indicative of a current through the lamp; and a control circuit operable to approximate a lamp power as a function of the first sensing voltage and the second sensing voltage, to compare the approximated lamp power and a reference voltage, and to regulate the power to the lamp based on the comparison of the approximated lamp power and the reference voltage, wherein said voltage sensor is in electrical communication with said control circuit to apply the first sensing voltage to said control circuit, and wherein said current sensor is in electrical communication with said control circuit to apply the second sensing voltage to said control circuit, wherein said control circuit includes:

a signal conditioner operable to amplify the second sensing voltage;

a summing circuit in electric communication with said signal conditioner whereby the amplified second sensing voltage is applied to said summing circuit, said summing circuit operable to generate a summation voltage as a function of a summation of the first sensing voltage and the amplified second sensing voltage, the summation voltage being indicative of the approximated lamp power;

a reference generator operable to generate the reference voltage; and a comparator in electric communication with said summing circuit whereby the summation voltage is applied to said comparator and in electric communication with said reference generator whereby the reference voltage is applied to said comparator, said comparator operable to compare the summation voltage and the reference voltage to thereby generate a control voltage for regulating the power to the lamp.

11. The system of claim 10, wherein said summing circuit includes means for adding a first absolute value of the first sensing signal and a second absolute value of the amplified second sensing signal to thereby generate the summation voltage.

12. The system of claim 10, wherein said summing circuit includes means for adding a first average of the first sensing signal and a second average of the amplified second sensing signal to thereby generate the summation voltage.

13. The system of claim 10, wherein the reference voltage has a sawtooth waveform.

14. The system of claim 10, wherein said control circuit further includes;

a current limiting circuit in electric communication with said comparator whereby the control voltage is applied to said current limiting circuit, wherein said current limiting circuit is operable to transition among a plurality of inductive states as a function of the control voltage, and wherein the current limiting circuit in electric communication with said lamp to regulate the power to the lamp as a function of the plurality of inductive states.

15. A system of controlling power to a high-intensity-discharge lamp, said system comprising;

a voltage sensor operable to generate a first sensing voltage indicative of a voltage across the lamp;

a current sensor operable to generate a second sensing voltage indicative of a current through the lamp; and a control circuit including means for amplifying the second sensing signal, means for adding a first absolute value of the first sensing signal and a second absolute value of the amplified second sensing signal to thereby generate a summation voltage indicative of an approximated lamp power, and means for comparing the summation voltage to a reference voltage to thereby generate a control voltage for regulating the power of the lamp.

16. The system of claim 15, wherein the reference voltage has a sawtooth waveform.

17. The system of claim 15, wherein said control circuit further includes:

means for transitioning among a plurality of inductive states as a function of the control voltage to thereby regulate the power to the lamp.

18. A system of controlling power to a high-intensity-discharge lamp, said system comprising:

a voltage sensor operable to generate a first sensing voltage indicative of a voltage across the lamp;

a current sensor operable to generate a second sensing voltage indicative of a current through the lamp; and a control circuit including means for amplifying the second sensing signal, means for adding a first average of the first sensing signal and a second average of the amplified second sensing signal to thereby generate a summation voltage indicative of an approximated lamp power;

means for comparing the summation voltage to a reference voltage to thereby generate a comparison voltage for regulating the power of the lamp.

19. The system of claim 18, wherein the reference voltage has a sawtooth waveform.

20. The system of claim 18, wherein said control circuit further includes:

means for transitioning among a plurality of inductive states as a function of the control voltage to thereby regulate the power to the lamp.

* * * * *